US006935285B2

(12) United States Patent
Yuasa et al.

(10) Patent No.: US 6,935,285 B2
(45) Date of Patent: Aug. 30, 2005

(54) TWO-CYCLE COMBUSTION ENGINE HAVING TWO-STAGED PISTON

(75) Inventors: Tsuneyoshi Yuasa, Kobe (JP); Yoshiro Yamane, Akashi (JP); Masanori Kobayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 10/412,523

(22) Filed: Apr. 11, 2003

(65) Prior Publication Data

US 2003/0192493 A1 Oct. 16, 2003

(30) Foreign Application Priority Data

Apr. 12, 2002 (JP) ..... 2002-110703

(51) Int. Cl.[7] ..... F02B 33/04
(52) U.S. Cl. ..... 123/73 PP
(58) Field of Search ..... 123/65 R, 193.6, 123/73 PP, 73 F, 65 S, 58.5, 58.6, 73 CC

(56) References Cited

U.S. PATENT DOCUMENTS 4,068,629 A * 1/1978 Hooper ..... 123/65 S
4,478,180 A * 10/1984 Fujikawa et al. ..... 123/58.6
4,481,909 A * 11/1984 Takada et al. ..... 123/73 CC
5,261,358 A * 11/1993 Rorke ..... 123/47 R
5,797,359 A * 8/1998 Freeman ..... 123/58.5

FOREIGN PATENT DOCUMENTS

JP 57-45890 9/1992
JP 05-118225 5/1993

* cited by examiner

*Primary Examiner*—Henry C. Yuen
*Assistant Examiner*—Hyder Ali

(57) ABSTRACT

A two-cycle combustion engine having a two-staged piston, is simple in structure and inexpensive and addresses a undesirable blow-off phenomenon of the air-fuel mixture. The two-cycle combustion engine includes a cylinder block having a two-staged cylinder bore with a reduced diameter bore portion and a large diameter bore portion, and a two-staged piston having a reduced diameter piston portion and a large diameter piston portion. An annular auxiliary chamber is defined between the two-staged cylinder bore and the reduced diameter piston portion. The two-cycle combustion engine also includes an air-fuel mixture passage for introducing the air-fuel mixture into a crank member, an air passage for introducing air into the auxiliary chamber, a scavenge passage for supplying the air-fuel mixture within the crank chamber into a combustion chamber, and injection passages and for injecting the air within the auxiliary chamber into the combustion chamber to counter a press-out issue.

22 Claims, 5 Drawing Sheets

TWO-CYCLE COMBUSTION ENGINE HAVING TWO-STAGED PISTON

BACKGROUND OF THE INVENTION

1. Field of the Invention

The present invention generally relates to a two-cycle combustion engine suitable for use as a power plant for a compact rotary machine such as a brush cutter and, more particularly, to the two-cycle combustion engine of a structure having a two-staged piston drivingly accommodated within a corresponding two-staged cylinder bore.

2. Description of the Related Art

The two-cycle combustion engine is generally of a design in which an air-fuel mixture introduced into a crank chamber is supplied into a combustion chamber to scavenge a combustion gas within the combustion chamber. Accordingly, the conventional two-cycle combustion engine is susceptible to a problem in that a portion of the air-fuel mixture supplied into the combustion chamber tends to flow outwardly through an exhaust port together with the combustion gas, that is, susceptible to a so-called blow-off phenomenon. In view of this, in order to avoid the blow-off phenomenon, attempts have been made to provide a two-cycle combustion engine in which a two-staged piston having small and large diameter piston portions is drivingly accommodated within a cylinder bore having small and large diameter bore portions.

More specifically, as the two-cycle combustion engine of the type discussed above, the Japanese Laid-open Patent Publication No. 5-118225 discloses the two-cycle combustion engine so designed and so configured that the air-fuel mixture introduced into a pump chamber defined between the large diameter bore portion of the two-staged cylinder bore in the cylinder block and the small diameter piston portion of the two-staged piston is fed under pressure into the combustion chamber from the pump chamber through a connecting passage during the ascending motion of the two-staged piston and that an intake valve for selectively opening or closing an intake port of the combustion chamber is opened at a timing at which an exhaust port is substantially closed by the small diameter piston portion of the two-staged piston then ascending to thereby prevent the air-fuel mixture, then introduced into the combustion chamber through the intake port, from flowing outwardly through the exhaust port.

Also, the Japanese Examined Patent Publication No. 57-45890 discloses the two-cycle combustion engine in which an injection nozzle is employed for injecting an air into the exhaust passage and an air is introduced into an auxiliary chamber defined between the large diameter bore portion of the two-staged cylinder bore and the small diameter piston portion of the two-staged piston, by opening a check valve during a descending motion of the two-staged piston and in which in synchronism with the last stage of the exhaust stroke during which the exhaust port is gradually closed as a result of the subsequent ascending motion of the two-staged piston, the air pressurized within the auxiliary chamber can be blown into the exhaust passage through the injection nozzle to thereby urge the air-fuel mixture, once discharged into the exhaust passage through the exhaust port, backwardly into the cylinder bore.

It has, however, been found that the first mentioned two-cycle combustion engine disclosed in the Japanese Laid-open Patent Publication No. 5-118225 has a problem in that it requires a mechanism for driving the intake valve for selectively opening or closing the intake port, through which the air-fuel mixture can be introduced into the combustion chamber, by means of a cam shaft or a crankshaft. In addition, the first mentioned two-cycle combustion engine requires a carburetor for supplying the air-fuel mixture into the pump chamber, an air cleaner for supplying an air into the crank chamber and the intake valve for selectively opening or closing the intake port through which the air-fuel mixture can be supplied from the pump chamber into the combustion chamber to be disposed having been spaced a distance from each other, resulting in complication in structure and increase in cost. Yet, since the air-fuel mixture is introduced into the combustion chamber during opening of the intake valve prior to the exhaust port being completely closed, it is not possible to completely eliminate the blow-off phenomenon of the air-fuel mixture.

On the other hand, the second mentioned two-cycle combustion engine disclosed in the Japanese Examined Patent Publication No. 57-45890 has a problem in that since the air-fuel mixture once discharged into the exhaust passage through the exhaust port is forced to return into the cylinder bore by the action of the air injected through the injection nozzle, the efficiency with which the blow-off phenomenon can be effectively prevented is low and, also, since a large amount of air and a high air pressure are necessary, the auxiliary chamber tends to increase in size. Also, since the timing at which the air under pressure is injected must be set to the last stage of the exhaust stroke, the exhaust port tends to be closed by the two-staged piston then ascending before the air-fuel mixture once entering the exhaust passage is urged backwardly into the cylinder bore and, therefore, the air-fuel mixture is no longer returned into the combustion chamber For these reasons, even in this two-cycle combustion engine, the blow-off phenomenon of the air-fuel mixture cannot be avoided effectively.

SUMMARY OF THE INVENTION

In view of the foregoing, the present invention has been devised to provide an improved two-cycle combustion engine of a kind having a two-staged piston, which is simple in structure and inexpensive and in which the undesirable blow-off phenomenon of the air-fuel mixture can be avoided effectively.

In order to accomplish the foregoing object of the present invention, a two-cycle combustion engine herein disclosed is of a type including a cylinder block having a two-staged cylinder bore defined therein and having a reduced diameter bore portion and a large diameter bore portion, a two-staged piston having a reduced diameter piston portion and a large diameter piston portion and drivingly accommodated within the two-staged cylinder bore, and an annular auxiliary chamber defined between the large diameter bore portion of the two-staged cylinder bore and the reduced diameter piston portion of the two-staged piston. The two-cycle combustion engine also includes an air-fuel mixture passage for introducing the air-fuel mixture into a crank chamber, an air passage for introducing an air into the auxiliary chamber, a scavenge passage for supplying the air-fuel mixture within the crank chamber into a combustion chamber, and an injection passage for injecting the air within the auxiliary chamber into the combustion chamber.

According to the present invention, with the two-cycle combustion engine so constructed as hereinabove described, when an exhaust inlet port provided in the cylinder bore is opened as the two-staged piston descends from the top dead center, a combustion gas within the combustion chamber can be discharged into an exhaust passage of the engine through the exhaust inlet port. After then, the air-fuel mixture compressed within the crank chamber as a result of the descending motion of the two-staged piston is supplied through the scavenge passage into the combustion chamber where a pressure is then lowering, to thereby facilitate exhaust of the combustion gas within the combustion chamber to the exhaust passage. During this scavenge stroke, a negative pressure is developed within the auxiliary chamber as a result of the descending motion of the two-staged piston and the air can therefore be introduced into the auxiliary chamber through the air passage. Accordingly, when the two-staged piston ascends subsequently, the pressure inside the auxiliary chamber increases as a result of the ascending motion of the two-staged piston with the air inside the auxiliary chamber consequently injected into the combustion chamber through the injection passage. By this injection of the air into the combustion chamber, a so-called press-out phenomenon can be advantageously suppressed, in which the air-fuel mixture within the combustion chamber is compressed as a result of the ascending motion of the two-staged piston to flow into the exhaust inlet port. In other words, since, unlike the injection into the exhaust passage as observed in the conventional combustion engine, the air is injected into the combustion chamber, the air-fuel mixture prone to flow into the exhaust inlet port can be urged to flow back to thereby prevent the air-fuel mixture from entering the exhaust inlet port. Accordingly, blow-off of the air-fuel mixture into the exhaust inlet port can be prevented effectively. Also, since mere provision of the injection passage through which the air within the auxiliary chamber can be injected into the combustion chamber is sufficient, the inexpensive and compact structure can be obtained easily.

In one preferred embodiment of the present invention, the injection passage has an injection port that opens into the two-staged cylinder bore at a location adjacent the exhaust inlet port. According to this structural feature, the air compressed within the auxiliary chamber can be injected into the combustion chamber so as to urge the air-fuel mixture, tending to flow into the exhaust inlet port, to flow back towards the combustion chamber and, therefore, the tendency of the air-fuel mixture to blow off into the exhaust inlet port by the effect of the press-out phenomenon can be avoided effectively. Also, the air-fuel mixture can be more distributed in the combustion chamber by the effect of injection of the air to form a homogeneous air-fuel mixture, resulting in increase of the combustion efficiency.

Preferably, the injection port can have an upper edge set to be aligned substantially with an upper edge of the exhaust inlet port. By so designing, the compressed air supplied through the injection passage from the auxiliary chamber during the ascending motion of the two-staged piston can be continuously injected into the combustion chamber up until the exhaust inlet port is completely closed by the ascending two-staged piston. Therefore, blow-off of the air-fuel mixture into the exhaust inlet port can effectively be prevented.

Preferably, the two-cycle combustion engine may further include a relief valve for relieving a pressure inside the injection passage that is higher than a predetermined value, and a discharge passage through which the air from the relief valve is discharged, said discharge passage having a downstream end opening into the exhaust passage. This structural feature is effective in that not only can the compressed air be injected directly from the auxiliary chamber into the combustion chamber up until the outlet of the injection passage is closed by the two-staged piston, but also, after the outlet of the injection passage has been closed by the two-staged piston then ascending, the air being gradually compressed within the auxiliary chamber as a result of the ascending motion of the two-staged piston can be supplied into the exhaust passage so that it can act as a secondary air effective to facilitate combustion of the unburned gases in the combustion gases. Accordingly, the amount of the HC component of the unburned gases contained in the exhaust gases can be reduced effectively and, also, the possibility of the pressure of the air within the injection passage to create a large resistance during the ascending motion of the two-staged piston can be prevented advantageously.

In another preferred embodiment of the present invention, the injection passage has an injection port that opens into the exhaust passage and is oriented towards the combustion chamber. According to this structural feature, since the air compressed within the auxiliary chamber can be injected from the exhaust passage towards the combustion chamber, the air so injected acts to urge the air-fuel mixture, tending to flow into the exhaust inlet port, to flow back towards the combustion chamber, therefore, not only can the possibility of the air-fuel mixture blowing off into the exhaust inlet port by the effect of the press-out phenomenon be further avoided effectively, but also after the exhaust inlet port has been closed by the two-staged piston then ascending, the air kept injected into the exhaust inlet port for a moment can act as a secondary air to thereby facilitate combustion of unburned gases in the combustion gases, resulting in effective reduction of the amount of HC component of unburned combustion gases contained in the exhaust gases.

In a still preferred embodiment of the present invention, the two-cycle combustion engine also includes a first check valve for selectively opening or closing the air passage, a second check valve for selectively opening or closing the air-fuel mixture passage and a third check valve for selectively opening or closing the injection passage. According to this structural feature, each of the air passage, the air-fuel mixture passage and the injection passage can be controlled for selective opening or closing by the corresponding check valve of a simplified structure so as to allow the flow to pass only when the pressure inside the corresponding passage attains a value higher than a predetermined value and, therefore, as compared with the case in which an intake valve or the like of a complicated structure that is driven to open and close by the cam shaft or the crankshaft provided in the conventional two-cycle combustion engine, the structure can be simplified to realize a cost reduction.

In the structure discussed above, in addition to the provision of the first to third check valves, the two-cycle combustion engine may further include a relief valve comprised of a fourth check valve for relieving a pressure inside the injection passage that is higher than a predetermined value. The pressure at which the relief valve opens is preferably set to a value higher than the pressure at which the third check valve opens. According to this structural feature, up until the pressure at which the relief valve opens is attained, the air within the injection passage can be continuously injected into the combustion chamber under a predetermined pressure determined by the pressure at which the third check valve opens. Accordingly, by the action of the air injected into the combustion chamber having overcome the increasing pressure of the air-fuel mixture gradually compressed within the combustion chamber as a result of the ascending motion of the two-staged piston, blow-off of the air-fuel mixture brought about by the press-out phenomenon can be prevented. Also, even though, after the outlet of the injection passage has been closed by the two-staged piston, the pressure of the air within the injection passage increases as a result of the ascending motion of the two-staged piston, the air can be discharged through the relief valve at the moment the pressure against the relief valve attains a value equal to the pressure at which the relief valve opens and, therefore, the pressure inside the injection passage will not create a large resistance during the ascending motion of the two-staged piston.

Preferably, the capacity of a portion of the injection passage which extends from the auxiliary chamber to the third check valve may preferably be set to a value smaller than the capacity of the auxiliary chamber then attaining when the two-staged piston is held at a bottom dead center. According to this structural feature, the amount of the air remaining in a portion of the injection passage upstream of the third check valve is small when the two-staged piston reaches the top dead center and therefore, when the two-staged piston starts its subsequent descending motion, a fresh air can be quickly introduced from the air passage into the auxiliary chamber.

In a still further preferred embodiment of the present invention, the injection passage may have an injection port opening in an inner peripheral surface of the two-staged cylinder bore, in which case a relief valve is provided for relieving a pressure inside the injection passage that is higher than a predetermined value. The pressure at which the relief valve opens is preferably set to a value substantially equal to or higher than a pressure within the combustion chamber that is attained when a scavenge outlet port opens as a result of a descending motion of the two-staged piston. According to this structural feature, when the scavenge outlet port opens as a result of the descending motion of the two-staged piston, the air remaining within the injection passage while sustaining a relatively high pressure can be injected into the combustion chamber which is under decreasing pressure as a result of the descend of the two-staged piston, to thereby prevent the air-fuel mixture, ready to be supplied from the scavenge outlet port into the combustion chamber, from flowing towards the exhaust inlet port and, therefore, the blow-off of the air-fuel mixture can be avoided during the descending stroke of the two-staged piston until the two-staged piston reaches the bottom dead center.

Preferably, a pressure accumulating chamber may be defined in the cylinder block at a location radially outwardly of the auxiliary chamber, in which case the pressure accumulating chamber is communicated with the auxiliary chamber through a connecting path which extends in a direction perpendicular to a longitudinal axis of the two-staged cylinder bore and forms a part of the injection passage, and a third check valve is preferably accommodated within the pressure accumulating chamber for selectively opening or closing the connecting path. By so designing, the connecting path communicating between the auxiliary chamber and the pressure accumulating chamber to form a part of the injection passage can be selectively opened or closed by the third check valve. Therefore, not only can the length of the connecting path between the auxiliary chamber and the pressure accumulating chamber be reduced, but also, in a situation where the third check valve is closed as a result of lowering of the pressure inside the auxiliary chamber during the descending motion of the two-staged piston, the air remaining within the pressure accumulating chamber while sustaining a relatively high pressure can be supplied into the combustion chamber, which is under decreasing pressure as a result of the descend of the two-staged piston, to thereby prevent the blow-off of a scavenge air.

In the structure discussed above, the injection passage may have a plurality of injection ports defined on left and right sides of the exhaust inlet port. In this case, the pressure accumulating chamber and said injection ports can be communicated with each other through a connecting passage forming a part of the injection passage. According to this structural feature, by the opening of the single third check valve during the ascending motion of the two-staged piston, the air can be injected into the combustion chamber from the plural injection ports positioned on respective sides of the exhaust inlet port by way of the auxiliary chamber and, also, during the descending motion of the two-staged piston, the air within the pressure accumulating chamber can be injected from the injection ports into the combustion chamber.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, preferred embodiments of the present invention will be described in detail with reference to the accompanying drawings.

Figure 1:
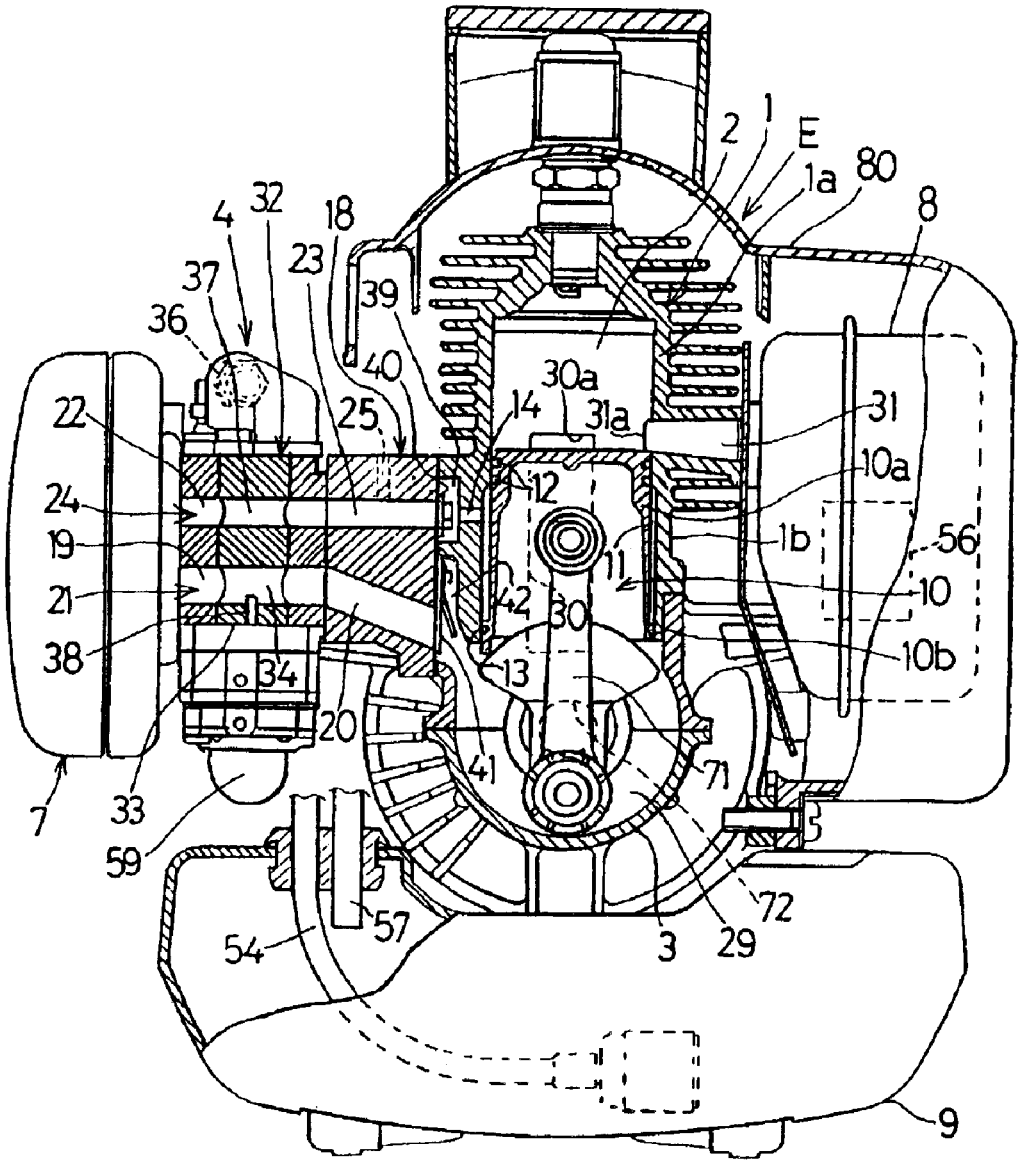
FIG. 1 is a front elevational view, with a portion broken away, of a two-cycle combustion engine according to a first preferred embodiment of the present invention, showing a two-staged piston arriving at the bottom dead center.

FIG. 1 illustrates a two-cycle combustion engine having a staged piston used therein in accordance with a first preferred embodiment of the present invention, which engine is shown in a front elevational representation with a portion broken away to show the staged piston arriving at the bottom dead center. The two-cycle combustion engine shown therein is shown as used with a brush cutter by way of example. An engine body E of the two-cycle combustion engine includes a cylinder block 1 having a combustion chamber 2 defined therein and fixedly mounted on a separate crankcase 3. A carburetor 4 and an air cleaner 7 forming an intake system are connected to a left-hand portion of the wall of the cylinder block 1 and a muffler 8 forming a part of an exhaust system is connected to a right-hand portion of the wall of the cylinder block 1. A fuel tank 9 is fitted to a bottom of the crankcase 3. The cylinder block 1 and the muffler 8 are covered by a shroud 80 for heat and noise insulation and also for guiding a cooling air.

The cylinder block 1 has a cylinder bore, stepped in two stages, including an upper bore portion 1*a* of a reduced inner diameter and a lower bore portion 1*b* of a large inner diameter coaxial with the upper bore portion 1*a*. A piston 10 accommodated within the cylinder bore of the cylinder block 1 is correspondingly stepped in two stages, including an upper piston portion 10*a* of a reduced outer diameter and a lower piston portion 10*b* of a large outer diameter coaxial with the upper piston portion 10*a*. Accordingly, the two-staged piston 10 is accommodated within the two-staged cylinder bore with the upper and lower piston portions 10*a* and 10*b* slidably inserted in the upper and lower bore portion 1*a* and 1*b* of the cylinder block 1, respectively. This two-staged piston 10 is coupled with a crankshaft 72 through a connecting rod 71. An annular auxiliary chamber 11 is defined between the lower bore portion 1*b* of the two-staged cylinder block 1 and the upper piston portion 10*a* of the two-staged piston 10. Also, a piston ring 12 is mounted on an outer periphery of the upper piston portion 10*a* of the two-staged piston 10 at a location adjacent an upper end portion thereof and is slidingly and sealingly held in contact with an inner peripheral surface of the upper bore portion 1*a* of the two-staged cylinder bore in the cylinder block 1. On the other hand, a circumferentially extending groove 13 is defined on an outer peripheral surface of the lower piston portion 10*b* of the two-staged piston 10 at a location adjacent a lower end portion thereof to define a labyrinth seal structure between it and the lower bore portion 1*b* of the two-staged cylinder bore in the cylinder block 1.

It is, however, to be noted that in place of the circumferentially extending groove 13, a piston ring may be used and mounted on the upper peripheral surface of the lower piston portion 10*b* of the two-staged piston 10.

The carburetor 4 referred to above is mounted on the cylinder block 1 of the engine body E through an insulator 18 made of a synthetic resin. This carburetor 4 and the insulator 18 have defined therein respective air supply ports 22 and 23 that are juxtaposed relative to each other. Those air supply ports 22 and 23 are utilized to supply the air, introduced therein through the air cleaner 7, into the auxiliary chamber 11 through a first valve chamber 39, defined between the insulator 18 and the two-stepped cylinder block 1, and an air inlet port 14 defined in the wall of the cylinder block 1, respectively. Accordingly, it will readily be understood that the air supply ports 22 and 23 and the air inlet port 14 altogether constitute an air passage 24 for introducing the air into the auxiliary chamber 11. An injection passage for injecting the air, introduced into the auxiliary chamber 11, into the combustion chamber 2 will be described in detail later. It is, however, to be noted that the air to be introduced into the auxiliary chamber 11 may be mixed with an oil in order to facilitate lubrication of an outer peripheral surface of the two-staged piston 10 and also to increase the sealing capability of a first check valve 40. In such case, the insulator 18 has to be formed with an oil supply port 27 communicated with the air supply port 23 so that the oil reserved in an oil tank (not shown) can be supplied by an oil pump (not shown) into the air supply port 23 through the oil supply port 27 to mix with the air.

The carburetor 4 and the insulator 18 are respectively formed with an air-fuel mixture supply port 19 and an air-fuel mixture intake port 20 that are juxtaposed relative to each other. The air-fuel mixture supply port 19 and the air-fuel mixture intake port 20 altogether constitute an air-fuel mixture passage 21 for introducing an air-fuel mixture, prepared by the carburetor 4 by mixing fuel with air, into a crank chamber 29 within the crankcase 3. A scavenge passage 30 for supplying the air-fuel mixture, introduced into the crank chamber 29, into the combustion chamber 2 is defined in an inner peripheral surface of the cylinder block 1 so as to open towards the cylinder bore. Also, the cylinder block 1 is formed with an exhaust passage 31 in communication with the muffler 8. This exhaust passage 31 has an exhaust inlet port 31*a* having its upper edge positioned at a level slightly higher than a scavenge outlet port 30*a* of the scavenge passage 30.

The carburetor 4 is provided with a single rotary valve 32 for simultaneously controlling the supply of the air-fuel mixture flowing through the air-fuel mixture supply port 19 and the supply of the air flowing through the air supply port 22, respectively. This rotary valve 32 includes a cylindrical valve body 33 having its upper portion formed with an air port 37, forming a part of the air passage 24, so as to extend radially therethrough and also having its lower portion formed with an intake port 34, forming a part of the air-fuel mixture passage 21, so as to extend radially therethrough, and is mounted on a casing of the carburetor 4 for rotation about a vertical axis of the carburetor casing. The intake port 34 is provided with a main nozzle 38 through which the fuel can be injected into the intake port 34. The rotary valve 32 is, during the engine body E being operated, driven by a rotary mechanism 36, mounted on the carburetor 4, for adjusting respective openings, that is, respective passage areas of the intake port 34 and the air port 37 relative to the air-fuel mixture passage 21 and the air passage 24 to thereby simultaneously adjust and control the respective amounts of the air-fuel mixture and air to be introduced from the passages 21 and 24 towards the crank chamber 29 and the auxiliary chamber 11.

The insulator 18 referred to above has fitted thereto the first check valve 40 for selectively opening or closing the air supply port 23 of the air passage 24, and a second check valve 41 for selectively opening or closing the air-fuel mixture intake port 20 of the air-fuel mixture passage 21. Each of those check valves 40 and 41 is employed in the form of a reed valve. The first check valve 40 is operable to allow the air to flow in a downstream direction, that is, to flow into the auxiliary chamber 11 through the first valve chamber 39, defined between the insulator 18 and the cylinder block 1, and the air intake port 14, but to inhibit the flow of such air in an upstream direction. On the other hand, the second check valve 41 is disposed within a second valve chamber 42 defined in an outer periphery portion of the cylinder block 1 and is operable to allow the air-fuel mixture to flow in a downstream direction, that is, to flow into the crank chamber 29, but to inhibit the flow of such air-fuel mixture in an upstream direction.

Figure 2:
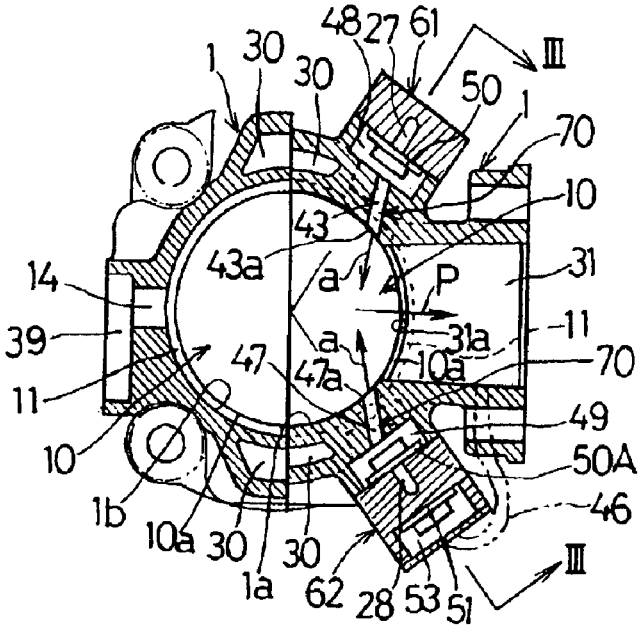
FIG. 2 is a transverse sectional view of a two-staged cylinder of the two-cycle combustion engine having the two-staged piston of FIG. 1, with the combustion engine shown as cut out at two different portions.
Figure 3:
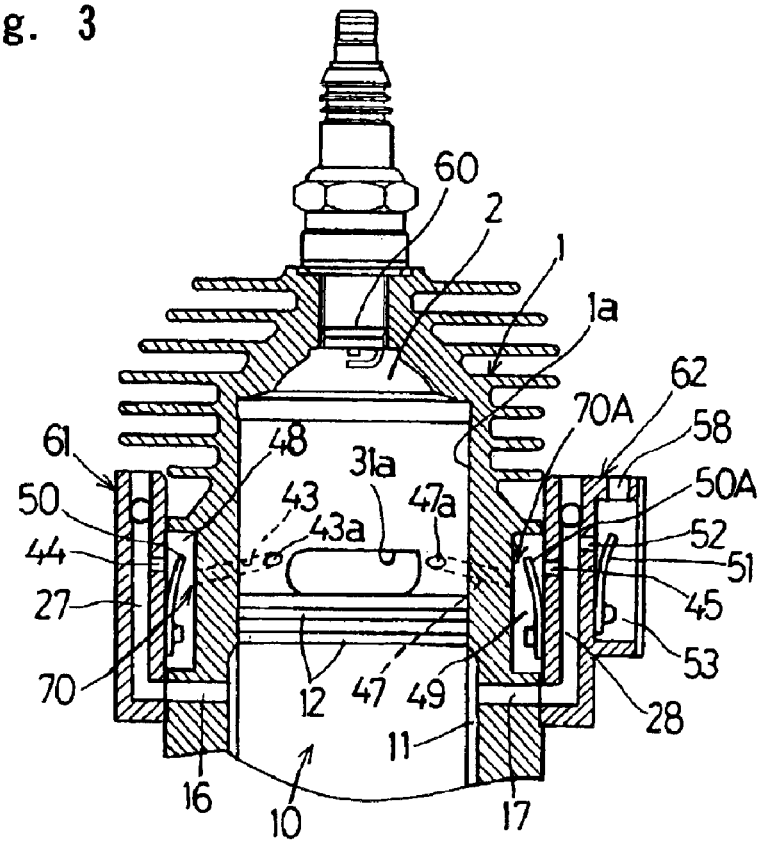
FIG. 3 is a cross-sectional view taken along the line III—III in FIG. 2.

FIG. 2 is a transverse sectional view of the two-staged cylinder block 1, with the two-cycle combustion engine shown as cut out at two different portions, and FIG. 3 is a cross-sectional view taken along the line III—III in FIG. 2. Referring to FIG. 2, the cylinder block 1 includes passage forming members 61 and 62 fitted externally thereto at respective locations in the vicinity of and on respective sides of the exhaust passage 31 with the exhaust passage 31 intervening therebetween. Those passage forming members 61 and 62 are, as best shown in FIG. 3, fixed externally to the cylinder block 1 in such a way that air outlet ports 16 and 17 defined in the cylinder block 1 can be aligned respectively with connecting passages 27 and 28 for connection between those respective ports and passages. Those air outlet ports are communicated with the auxiliary chamber 11 and, therefore, the air compressed within the auxiliary chamber 11 can be supplied into the connecting passages 27 and 28. The passage forming members 61 and 62 are formed with uptake ports 44 and 45 that are branched off from the connecting passages 27 and 28, respectively, with third valve chambers 48 and 49 consequently defined between them and the cylinder block 1.

The cylinder block 1 is also formed with injecting guide paths 43 and 47 through which the compressed air introduced into the valve chambers 48 and 39 can be injected into the combustion chamber 2. Injection ports 43*a* and 47*b* of the associated injecting guide paths 43 and 47 that open towards the two-stepped cylinder bore in the cylinder block 1 are defined at respective locations on left and right sides of the exhaust inlet port 31*a* of the exhaust passage 31 with upper edges of those injection ports 43*a* and 47*a* substantially aligned with an upper edge of the exhaust inlet port 31*a*. It is to be noted that the air outlet ports 16 and 17, the connecting passages 27 and 28, the uptake ports 44 and 45 and the injecting guide paths 43 and 47 altogether define respective injection passages 70 and 70A through which the air within the auxiliary chamber 11 can be injected into the combustion chamber 2.

The third valve chambers 48 and 49 referred to above are provided respectively with third check valves 50 and 50A, each being in the form of a reed valve, for selectively opening or closing the associated injection passages 70 and 70A. Also, the sum of respective volumes of the air outlet ports 16 and 17 and the connecting passages 27 and 28 of the associated injection passages 70 and 70A, that extend from corresponding outlets of the auxiliary chamber 11 to the third check valves 50 and 50A, is so chosen as to be smaller than the volume of the auxiliary chamber 11 at the time of the two-staged piston 10 held at the bottom dead center.

One of the passage forming members, that is, the passage forming member 62 is formed with a discharge port 52, a fourth valve chamber 53 and a discharge mouth 58, and the fourth valve chamber 53 has a fourth check valve 51 in the form of a reed valve fitted thereto for selectively opening or closing the discharge port 52. The pressure at which the fourth check valve 51 opens is so chosen as to be higher than the pressure at which each of the third check valves 50 and 50A opens. Accordingly, the fourth check valve 51 serves as a relief valve and opens, when the pressure of the air within the injection passages 70 and 70A exceeds a predetermined value, to discharge the air from the discharge port 52 into the fourth valve chamber 53 to thereby relieve the pressure of the air exceeding the predetermined value. The air discharged into the fourth valve chamber 53 as a result of the opening of the fourth check valve 51 is subsequently discharged to the outside of the combustion engine by way of the discharge mouth 58. It is, however, to be noted that instead of the air being discharged to the outside of the combustion engine, as shown in FIG. 2, the discharge mouth 58 and the exhaust passage 31 may be communicated with each other by means of a discharge tube 46 forming a discharge passage so that the air within the fourth valve chamber 53 can be discharged into the exhaust passage 31 by way of the discharge tube 46. Respective scavenge outlet ports 30*a* of the two scavenge passages 30 defined in the cylinder block 1 are spaced substantially 90° from each other in a circumferential direction about the longitudinal axis of the cylinder bore.

It is to be noted that as shown in FIG. 1, the fuel within the fuel tank 9 can be supplied to the carburetor 4 through a fuel supply tube 54. Also, when a manually operable member 59 of a circulating pump (not shown) is pressed before the start of the combustion engine, the fuel within the fuel tank 9 can be sucked into the carburetor 4 through the fuel supply tube 54 while a surplus of the fuel can be circulated back to the fuel tank 9 from a fuel discharge port (not shown) of the carburetor 4 through a fuel return tube 57.

Hereinafter, the operation of the two-cycle combustion engine of the structure described above will be discussed.

When the two-staged piston 10 descends towards the bottom dead center as shown in FIG. 1, a negative pressure is developed within the auxiliary chamber 11 and, therefore, the first check valve 40 opens to allow the air from the air cleaner 7 to be introduced into the auxiliary chamber 11 through the air passage 24 including the air supply ports 22 and 23 and the air inlet port 14. In this two-cycle combustion engine, since the volume of a portion of each of the injection passages 70 and 70A that extends from the auxiliary chamber 11 to the third check valve 50 is so chosen as to be smaller than the volume of the auxiliary chamber 11 that is attained when the two-staged piston 10 arrives at the bottom dead center, a relatively small amount of the air remains only in an upstream portion of each of the third check valves 50 and 50A within the associated injection passages 70 and 70A at the moment the two-staged piston 10 arrives at the top dead center and, therefore, even though the air remaining in that upstream portion is likely to flow back towards the auxiliary chamber 11 when the two-staged piston 10 subsequently starts its descending motion, the auxiliary chamber 11 will not be filled with the air and a fresh air can be quickly introduced into the auxiliary chamber 11 through the air passage 24.

During the descend stroke of the two-staged piston 10, the exhaust inlet port 31*a* opens first to allow combustion gases within the combustion chamber 2 to be discharged into the exhaust passage 31. On the other hand, since the pressure within the crank chamber 29 increases as a result of the descend of the two-staged piston 10, the second check valve 41 is kept in a closed position. When the scavenge outlet port 30*a* is subsequently opened, the air-fuel mixture having been introduced into the crank chamber 29 is released into the combustion chamber 2 through the scavenge passage 30 by way of the scavenge outlet port 30*a* to purge the combustion gases towards the exhaust inlet port 31*a*.

Then, the air introduced into the auxiliary chamber 11 is supplied into the connecting passages 27 and 28 through the air outlet ports 16 and 17 shown in FIG. 3 as the volume of the auxiliary chamber 11 decreases incident to the two-staged piston 10 ascending from the bottom dead center, and is subsequently compressed to a pressure equal to the pressure at which the third check valves 50 and 50A open. When the pressure of the air within the connecting passages 27 and 28 attains a value exceeding the pressure at which the third check valves 50 and 50A open, the third check valves 50 and 50A opens to allow the air within the connecting passages 27 and 28 to be injected into the combustion chamber 2 through the uptake ports 44 and 45, the third valve chambers 48 and 49 and finally through the injecting guide paths 43 and 47, respectively.

As best shown in FIG. 2, the direction in which the air a is injected from respective injection ports 43*a* and 47*a* of the injecting guide paths 43 and 47 has a direction component reverse to the direction of flow P of the combustion gases flowing out of the exhaust passage 31. Also, the timing of the air injected into the combustion chamber 2 is so chosen that the air can be injected directly into the combustion chamber 2 shortly before the air-fuel mixture within the combustion chamber 2 is compressed and is subsequently urged to flow into the exhaust inlet port 31*a* as a result of the ascending motion of the two-staged piston 10, that is, shortly before the so-called press-out phenomenon occurs. This timing of injecting the air can be determined in dependence on the pressure at which the third check valves 50 and 50A open. Also, the direction in which the air is injected has to be an optimum direction effective to avoid the press-out phenomenon.

In view of the above, in the two-cycle combustion engine of the present invention, since unlike the injection of the air into the exhaust passage such as observed in the conventional combustion engine, the air injected into the combustion chamber 2 is utilized to urge the air-fuel mixture, then flowing towards the exhaust inlet port 31*a*, back to thereby prevent the air-fuel mixture from flowing into the exhaust inlet port 31*a*, blow-off of the air-fuel mixture into the exhaust inlet port 31*a* can be prevented effectively. Also, in this two-cycle combustion engine, since the upper edges of the respective injection ports 43*a* and 47*a* shown in FIG. 3 are so positioned as to substantially align with the upper edge of the exhaust inlet port 31*a*, the air can be continuously injected into the combustion chamber 2 until the exhaust inlet port 31*a* is completely closed by the two-staged piston 10 then ascending towards the top dead center and, therefore, blow-off of the air-fuel mixture into the exhaust inlet port 31*a* can further be prevented effectively.

When the injection ports 43*a* and 47*a* are closed by the two-staged piston 10 then ascending and the two-staged piston 10 further ascends after the closures of the injection ports 43*a* and 47*a*, the pressure of the air inside the injection passages 70 and 70A abruptly increases to a value exceeding the pressure at which the fourth check valve 51 opens. As a result, the fourth check valve 41 opens and the air inside the connecting passages 27 and 28 are discharged either to the outside through the discharge mouth 58 by way of the discharge port 52 and then the fourth valve chamber 53 or into the exhaust passage 31 through the discharge tube (the discharge passage) 46 shown in FIG. 2 and, accordingly, it is possible to prevent the pressure of the air inside the injection passages 70 and 70A and, hence, within the auxiliary chamber 11 from creating a large resistance during the ascending motion of the two-staged piston 10. Also, where the air is discharged into the exhaust passage 31, this air serves as a secondary air which acts to facilitate combustion of unburned gases of the combustion gases and, therefore, the amount of HC contained in the unburned gases in the exhaust gases can effectively be reduced. In particular, as shown in FIG. 1, where the muffler 8 is provided with a catalyst unit 56, the unburned gases of the combustion gases can effectively be re-burned in the presence of the air discharged into the exhaust passage 31.

On the other hand, since the negative pressure is developed within the crank chamber 29 during the ascending motion of the two-staged piston 10, the second check valve 41 opens to allow the air-fuel mixture to be introduced from the air-fuel mixture passage 21 into the crank chamber 29. As the two-staged piston 10 then ascending nears the top dead center, the air-fuel mixture compressed within the combustion chamber 2 is fired by an ignition plug 60 to explode with the two-staged piston 10 consequently starting its descending motion.

As hereinabove described, in the two-cycle combustion engine according to the foregoing embodiment, since blow-off of the air-fuel mixture resulting from the press-out phenomenon tending to occur during the ascending motion of the two-staged piston 10 can effectively be avoided, not only can a low fuel consumption and reduction in concentration of HC in the exhaust gas be achieved, but the following advantages can also be obtained. Specifically, the carburetor 4 includes, in addition to the air-fuel mixture supply port 19 forming a part of the air-fuel mixture passage 21, the air supply port 22 forming a part of the air passage 24 and, on the other hand, the respective openings of the intake port 34 and the air port 37 relative to the air-fuel mixture passage 21 and the air passage 24 can be adjusted by rotating the single rotary valve 32 during the operation of the combustion engine, so that the amounts of the air-fuel mixture and the air to be supplied, respectively, can be simultaneously adjusted and controlled. Because of these reasons, unlike the conventional two-cycle combustion engine in which the carburetor, the air cleaner and the intake valve are independently and separately disposed, the two-cycle combustion engine embodying the present invention can advantageously be compactized in its entirety.

Also, with the two-cycle combustion engine embodying the present invention, the air passage 24, the air-fuel mixture passage 21 and the injection passages 70 and 70A are controlled for their opening and closing by the simple check valves 40, 41, 50 and 50A, respectively, each operable to allow the flow therethrough only when the pressure exceeds a predetermined value. Therefore, as compared with the use of the intake valve of a complicated structure necessary to be selectively opened or closed by a cam shaft or a crankshaft employed in the conventional two-cycle combustion engine, the structure can advantageously be simplified, resulting in reduction in cost.

It is to be noted that instead of the arrangement in which the air discharged from the discharge mouth 58 is discharged into the exhaust passage 31 such as hereinabove described, an alternate arrangement may be made so that the air discharged from the discharge mouth 58 can be recovered on a downstream side of a cleaner element contained in the air cleaner 7. Also, although in the foregoing embodiment the two injecting guide paths 43 and 47 have been shown and described as positioned on the left and right sides of the exhaust inlet port 31*a* of the exhaust passage 31, the number of the injection ports may not be always limited to two and only one injection port may be employed.

Figure 4:
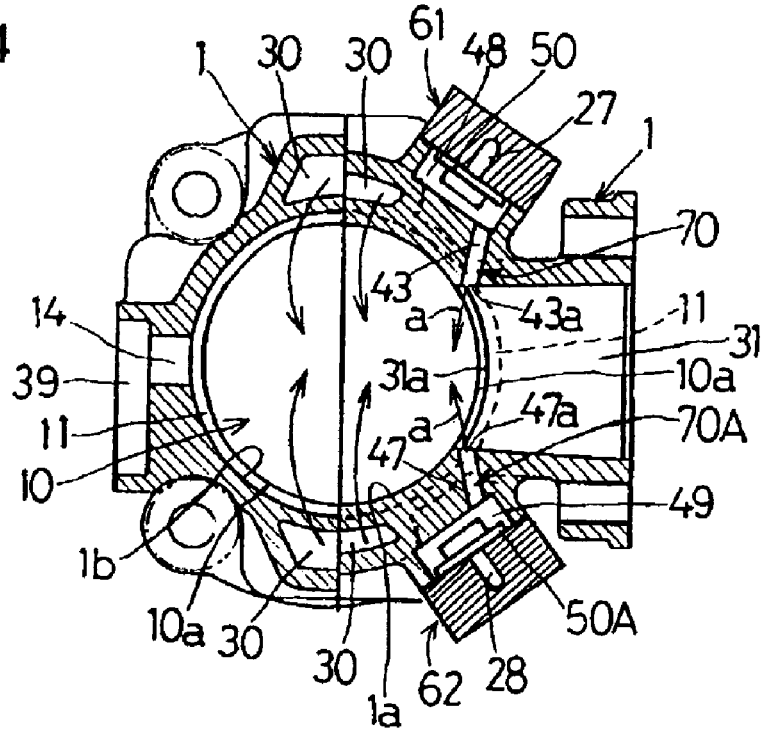
FIG. 4 is a transverse sectional view of the two-staged cylinder of the two-cycle combustion engine having the two-staged piston according to a second preferred embodiment of the present invention, with the combustion engine shown as cut out at two different portions.

FIG. 4 illustrates, in a transverse sectional representation, the two-staged cylinder of the two-cycle combustion engine according to a second preferred embodiment of the present invention, with the combustion engine shown as cut out at two different portions. Referring to FIG. 4, component parts similar to those shown in FIG. 2 are designated by like reference numerals and, therefore, the details thereof are not reiterated for the sake of brevity. In the second embodiment shown in FIG. 4, the injection ports 43*a* and 47*a* of the respective injecting guide paths 43 and 47 are so disposed as to open towards the exhaust passage 31 while being oriented directly towards the combustion chamber 2. Accordingly, after the injection ports 43*a* and 47*a* have been closed by the two-staged piston 10 then ascending, the air within the auxiliary chamber 11 can be discharged into the exhaust passage 31 and, therefore, the fourth valve chamber 53 in combination with the fourth check valve 51 such as employed in the first embodiment is not provided in the passage forming member 61 employed in this second embodiment.

According to the second embodiment described above, since the air a compressed within the auxiliary chamber 11 is injected into the combustion chamber 2 through the exhaust inlet port 31*a* of the exhaust passage 31, the injected air a can urge the air-fuel mixture, then flowing towards the exhaust inlet port 31*a*, back to prevent the air-fuel mixture from entering the exhaust inlet port 31*a* and, therefore, the possibility of the air-fuel mixture being blown off from the exhaust inlet port 31*a* by the effect of the press-out phenomenon can advantageously be avoided. In addition thereto, as is the case with the first embodiment, after the exhaust inlet port 31*a* has been closed by the two-staged piston 10 then ascending, the air still injected into the exhaust passage 31 through the injecting guide paths 43 and 47 for a moment serves as a secondary air which acts to facilitate combustion of unburned gases and, therefore, the amount of HC contained in the unburned gases in the exhaust gases can effectively be reduced. In other words, the second embodiment has the effects similar to the first embodiment while the discharge tube 46, the fourth check valve 51 and the fourth valve chamber 53 shown in FIG. 2 and employed in the first embodiment is dispensed with.

Figure 5:
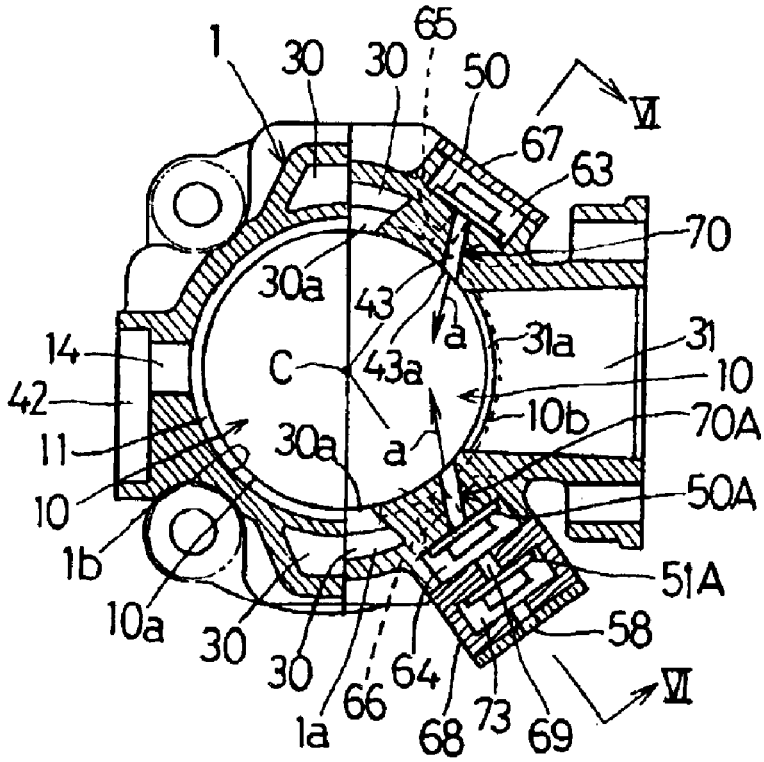
FIG. 5 is a transverse sectional view of the two-staged cylinder of the two-cycle combustion engine having the two-staged piston according to a third preferred embodiment of the present invention, with the combustion engine shown as cut out at two different portions.
Figure 6C:
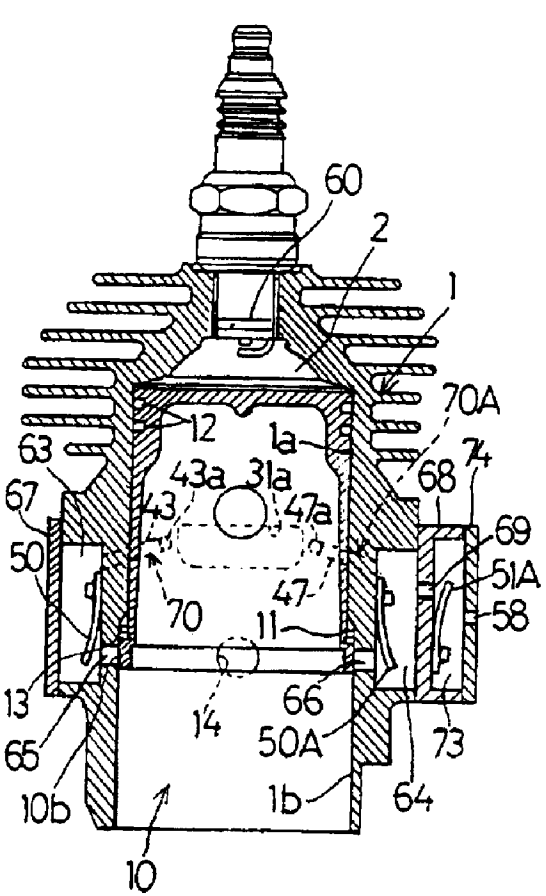
FIGS. 6A to 6C are cross-sectional views taken along the line VI—VI in FIG. 5, showing the two-staged piston held at the bottom dead center, an intermediate position and the top dead center, respectively.
Figure 6B:
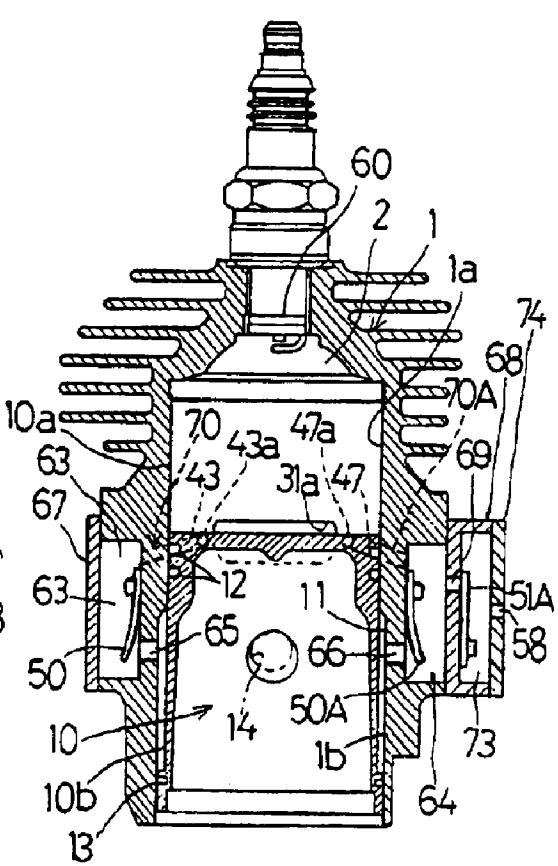
Figure 6A:
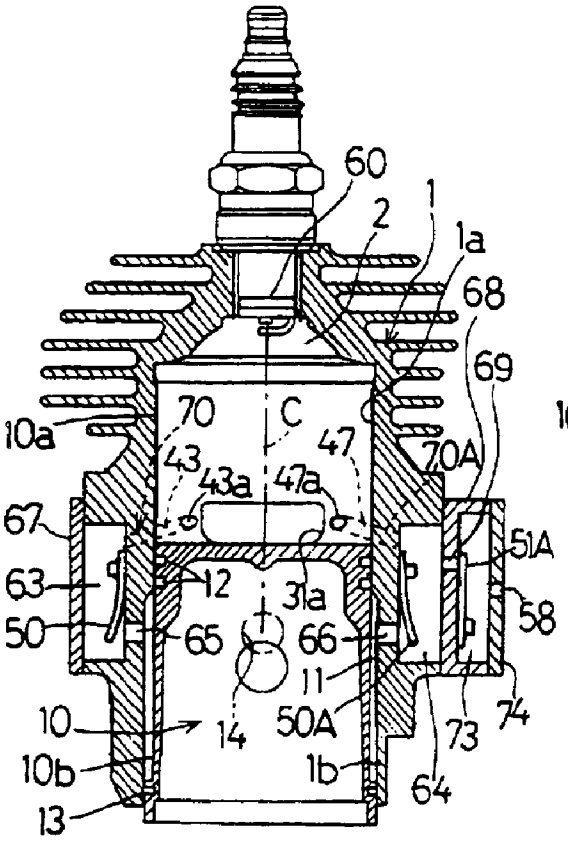

FIG. 5 illustrates, in a transverse sectional view, the two-staged cylinder the two-cycle combustion engine according to a third preferred embodiment of the present invention, with the combustion engine shown as cut out at two different portions, and FIGS. 6A to 6C are cross-sectional views taken along the line VI—VI in FIG. 5, showing the two-staged piston held at the bottom dead center, an intermediate position and the top dead center, respectively. In these figures, component parts similar to those shown in and described with reference to FIGS. 1 to 3 are designated by like reference numerals and, therefore, the details thereof are not reiterated for the sake of brevity.

In this third embodiment shown in FIGS. 5 and 6A to 6C, connecting paths 65 and 66 are defined in the cylinder block 1 so as to extend from the auxiliary chamber 11 to the outside in a radial direction as shown in FIG. 6A and are positioned at respective locations opposite sides of the exhaust passage 31 in the cylinder block 1 and spaced about 45° from the exhaust passage 31 about the longitudinal axis C of the cylinder bore in the cylinder block 1 as shown in FIG. 5. In addition, relatively large recesses communicated with the associated connecting paths 65 and 66 are formed at respective locations outside the connecting paths 65 and 66 in the cylinder block 1, and one of those recesses is covered by a lid member 67 to define a pressure accumulating chamber 63 serving concurrently as a third valve chamber, while the other of the recesses is covered by a valve chamber defining member 68 to define a pressure accumulating chamber 64 serving concurrently as a third valve chamber.

More specifically, in this third embodiment, the pressure accumulating chambers 63 and 64 are defined radially outwardly of the auxiliary chamber 11 in the cylinder block 1, and the auxiliary chamber 11 and the pressure accumulating chambers 63 and 64 are communicated respectively by the associated connecting paths 65 and 66 extending in a direction perpendicular to the longitudinal axis C of the cylinder bore to form respective parts of the injection passages 70 and 70A. The pressure accumulating chambers 63 and 64 have a capacity larger than that of the third valve chambers 48 and 49 employed in the first embodiment, and the third check valves 50 and 50A for selectively opening or closing the associated connecting paths 65 and 66 are accommodated within these pressure accumulating chambers 63 and 64, respectively. Also, the injecting guide paths 43 and 47 defined in the cylinder block 1 are respectively communicated to the upper portions of the pressure accumulating chambers 63 and 64, while the injection ports 43*a* and 47*a* that serve as respective outlets of the injecting guide paths 43 and 47 are so defined as to open at respective locations on left and right sides of the exhaust inlet port 31*a*.

The valve chamber defining member 68 referred to above is closed by a lid member 74 with a fourth valve chamber 73 consequently defined between it and the lid member 74. This fourth valve chamber 73 is in communication with the pressure accumulating chamber 64 through a discharge port 69 that is adapted to be selectively opened or closed by a fourth check valve 51A accommodated within the fourth valve chamber 73. The pressure at which this fourth check valve 51A opens is so chosen as to be equal to or higher than the pressure inside the combustion chamber 2 at the time the scavenge outlet port 30*a* opens during the descending motion of the two-staged piston 10. Accordingly, when this fourth check valve 51A opens, the air flowing into the fourth valve chamber 73 can be discharged either to the outside of the combustion engine through the discharge mouth 58 or into the exhaust passage 31 through an exhaust tube (not shown). Also, as shown in FIG. 6A, the injection ports 43*a* and 47*a* of the respective injecting guide paths 43 and 47 in the injection passages 70 and 70A are so positioned as to occupy respective levels lower than those in the previously described first embodiment and generally intermediate between the upper edge of the exhaust inlet port 31*a* and the upper edge of the scavenge outlet port 30*a* (FIG. 5) located therebelow.

In this two-cycle combustion engine according to the third embodiment, when the two-staged piston 10 ascends from the bottom dead center as shown in FIG. 6A, the third check valves 50 and 50A open to allow the air of a pressure increasing within the auxiliary chamber 11 to be injected into the combustion chamber 2 through the connecting paths 65 and 66, then through the pressure accumulating chambers 63 and 64 and finally through the injecting guide paths 43 and 47 by way of the injection ports 43*a* and 47*a*, respectively. Injection of this air into the combustion chamber 2 continues up to the time at which the injection ports 43*a* and 47*a* are closed by the two-staged piston 10 as shown in FIG. 6B. Accordingly, blow-off of the air-fuel mixture into the exhaust inlet port 31*a* by the effect of the press-out phenomenon can effectively be prevented. Also, when the two-staged piston 10 continues to ascend towards the top dead center as shown in FIG. 6C, the air compressed within the auxiliary chamber 11 opens the fourth check valve 51A and then flow into the fourth valve chamber 73 through the discharge port 69, finally being discharged through the discharge mouth 58. Therefore, the possibility can be prevented in which abrupt increase of the pressure inside the auxiliary chamber 11 results in a large resistance to the ascending motion of the two-staged piston 10.

When the two-staged piston 10 arrives at the top dead center as shown in FIG. 6C, the connecting paths 65 and 66 are closed by the large diameter piston portion 10*b* of the two-staged piston 10. When the two-staged piston 10 then at the top dead center starts its descending motion, the pressure inside the auxiliary chamber 11 decreases with the third check valves 50 and 50A consequently kept in a closed position and, therefore, the air within the pressure accumulating chambers 63 and 64 continues to be kept at a relatively high pressure. However, when the two-staged piston 10 then descending arrives at such a position as shown in FIG. 6B, the exhaust inlet port 31*a* opens, followed by opening of the injection ports 43*a* and 47*a*, shortly before the opening of the scavenge outlet port 30*a* (FIG. 5) and, accordingly, injection of the air into the combustion chamber 2 starts. In other words, since, at the time the injection ports 43*a* and 47*a* start opening, the pressure at which the fourth check valve 51A opens is set to a value substantially equal to or higher than the pressure inside the combustion chamber 2, the fourth check valve 51A is kept in a closed position and, therefore, the air remaining within the pressure accumulating chambers 63 and 64 while sustaining a relatively high pressure can be injected through the injection ports 43*a* and 47*a* into the combustion chamber 2 of which pressure decreases as the two-staged piston 10 descends. Accordingly, even during the exhaust stroke in which the two-staged piston descends, the possibility can be advantageously avoided in which the air-fuel mixture, once introduced into the combustion chamber 2, is blown off into the exhaust inlet port 31*a* by the action of the air injected into the combustion chamber 2 from the pressure accumulating chambers 63 and 64.

Also, in the two-cycle combustion engine according to this third embodiment, since the use is made of the pressure accumulating chambers 63 and 64 that extend radially outwardly of the auxiliary chamber 11 as shown in FIG. 6*a* and are communicated with the auxiliary chamber 11 through the respective connecting paths 65 and 66 extending in a direction perpendicular to the longitudinal axis C of the cylinder bore, and since the connecting paths 65 and 66 are communicated at the shortest available distance with the auxiliary chamber 11 and the pressure accumulating chambers 63 and 64, the respective lengths can advantageously be shortened to a value as small as possible. Also, since the third check valves 50 and 50A are accommodated within the respective pressure accumulating chambers 63 and 64, the entire structure can be compactized advantageously. It is to be noted that the respective capacities of the auxiliary chamber 11 and the pressure accumulating chambers 63 and 64 are so chosen as to optimally conform to the characteristics of the individual combustion engine.

Figure 7A:
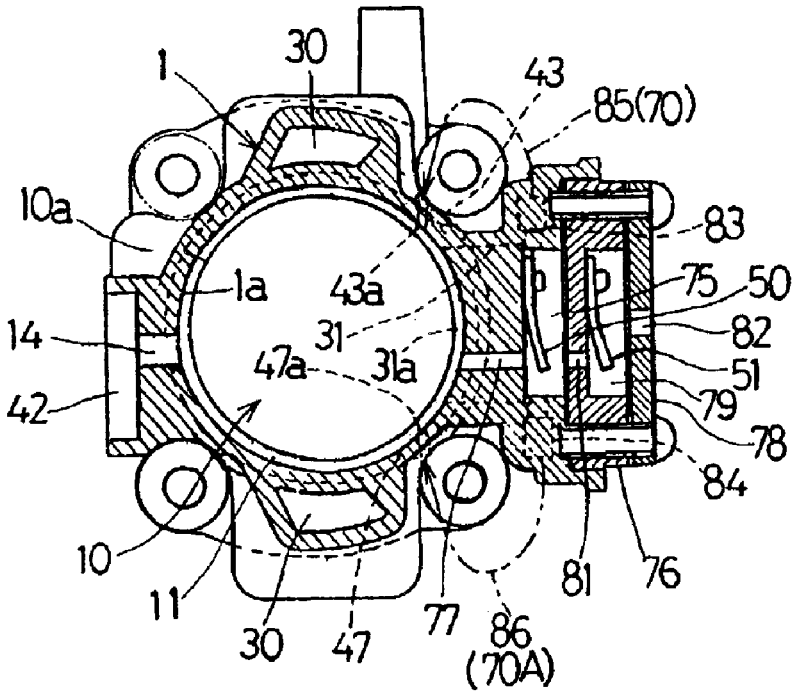
FIG. 7A is a transverse sectional view of the two-cycle combustion engine having the two-staged piston according to a fourth preferred embodiment of the present invention, showing the details of a two-staged cylinder bore defined in a cylinder block.
Figure 7B:
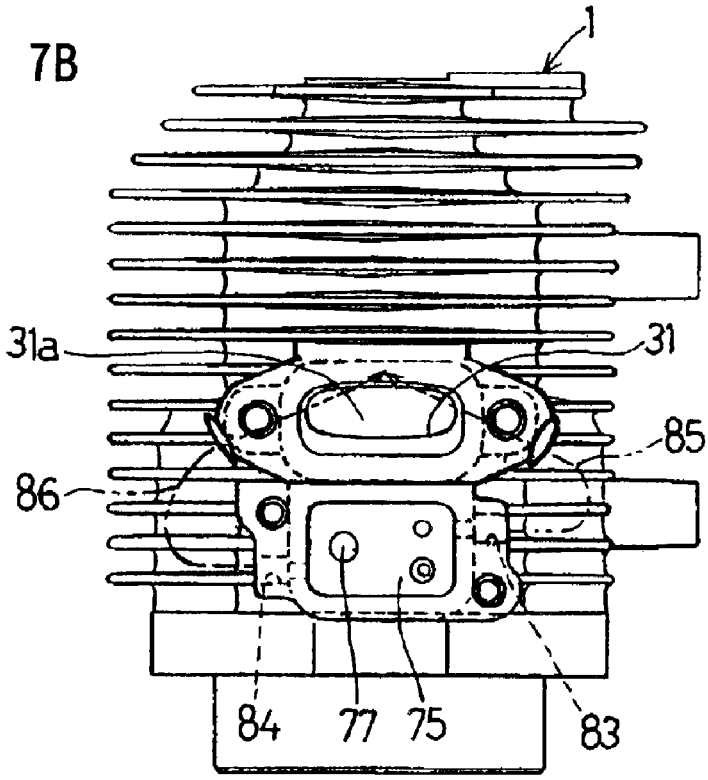
FIG. 7B is a right side view of the cylinder block shown in FIG. 7A.

FIG. 7A is a transverse sectional view of the two-staged cylinder block 1 showing the two-cycle combustion engine having the two-staged piston according to a fourth preferred embodiment of the present invention, and FIG. 7B is a right side view of the cylinder block 1. In these figures, component parts similar to those shown in FIG. 2 are designated by like reference numerals and, therefore, the details thereof are not reiterated for the sake of brevity.

In the two-cycle combustion engine according to the fourth embodiment, a valve chamber defining member 76 is fixed to the cylinder block 1 at a location radially outwardly of the auxiliary chamber 11 to define a single pressure accumulating chamber 75. This pressure accumulating chamber 75 is communicated with the auxiliary chamber 11 through a connecting path 77 extending in a direction perpendicular to the longitudinal axis C of the cylinder bore to form a part of each of the injection passages 70 and 70A. This connecting path 77 is selectively opened or closed by the third check valve 50 fitted inside the pressure accumulating chamber 75 that is positioned below the exhaust passage 31 in the cylinder block 1 as shown in FIG. 7B.

Air outlet ports 83 and 84 are defined on opposite sides of the pressure accumulating chamber 75 and are communicated with the injecting guide paths 43 and 47, as shown in FIG. 7A, through connecting passages 85 and 86 each in the form of a connecting pipe, respectively. The injection ports 43*a* and 47*a* open in the two-staged cylinder bore of the cylinder block 1 at respective locations on opposite sides of the exhaust passage 31. The valve chamber defining member 76 is closed by a lid member 78 to thereby define a fourth valve chamber 79 inside it. A discharge port 81 communicating between the fourth valve chamber 79 and the pressure accumulating chamber 75 is selectively opened or closed by a fourth check valve 51 in the form of a relief valve. The air flowing into the fourth valve chamber 79 during opening of the fourth check valve 51 is discharged either to the outside of the combustion engine through a discharge mouth 82 or into the exhaust passage 31 through an exhaust tube (not shown) as shown in FIG. 7B.

According to the foregoing fourth embodiment, as is the case with the third embodiment shown in and described with reference to FIGS. 5 and 6A to 6C, the blow-off of the air-fuel mixture will be prevented during both the ascending motion and the descending motion of the two-staged piston 10. Also, the entire structure can be compactized since the use of the single connecting path 77, the pressure accumulating chamber 75 and the third check valve 50 is sufficient while having the two injection ports 43*a* and 47*a*.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an exhaust passage for removing combustion gases from the combustion chamber; and an injection passage formed in the cylinder block for injecting the air within the auxiliary chamber into the combustion chamber and having an injection port that opens into the two-staged cylinder bore at a location adjacent an exhaust inlet port of the exhaust passage and between the exhaust inlet port and a scavenge outlet port of the scavenge passage, the exhaust inlet port being defined on the cylinder bore.

2. The two-cycle combustion engine as claimed in claim 1, wherein the injection port has an upper edge aligned substantially with an upper edge of the exhaust inlet port.

3. The two-cycle combustion engine as claimed in claim 1, further comprising a first check valve for selectively opening or closing the air passage, a second check valve for selectively opening or closing the air-fuel mixture passage and a third check valve for selectively opening or closing the injection passage.

4. The two-cycle combustion engine as claimed in claim 3, further comprising a fourth check valve comprised of a relief valve for relieving a pressure inside the injection passage that is higher than a predetermined value, the pressure at which the relief valve opens being set to a value higher than the pressure at which the third check valve opens.

5. The two-cycle combustion engine as claimed in claim 3, wherein the capacity of a portion of the injection passage which extends from the auxiliary chamber to the third check valve is set to a value smaller than the capacity of the auxiliary chamber then attaining when the two-staged piston is held at a bottom dead center.

6. The two-cycle combustion engine as claimed in claim 1, further comprising a relief valve for relieving a pressure inside the injection passage that is higher than a predetermined value, the pressure at which the relief valve opens being set to a value substantially equal to or higher than a pressure within the combustion chamber that is attained when a scavenge outlet port of the scavenge passage opens as a result of a descending motion of the two-staged piston.

7. The two-cycle combustion engine as claimed in claim 6, further comprising a pressure accumulating chamber defined in the cylinder block at a location radially outwardly of the auxiliary chamber, said pressure accumulating chamber being communicated with the auxiliary chamber through a connecting path which extends in a direction perpendicular to a longitudinal axis of the two-staged cylinder bore to form a part of the injection passage, and a third check valve accommodated within the pressure accumulating chamber for selectively opening or closing the connecting path.

8. The two-cycle combustion engine as claimed in claim 7, wherein the injection passage has a plurality of injection ports defined on left and right sides of an exhaust inlet port, respectively, said pressure accumulating chamber and said injection ports being communicated with each other through a connecting passage forming a part of the injection passage.

9. The two-cycle combustion engine as claimed in claim 1 further including a rotary valve that simultaneously controls the air-fuel mixture to the air-fuel mixture passage and the air to the air passage.

10. The two-cycle combustion engine as claimed in claim 1 wherein the injection port is defined on respective left and right sides of the exhaust inlet port.

11. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an exhaust passage for removing combustion gases form the combustion chamber;

an injection passage for injecting the air within the auxiliary chamber into the combustion chamber, wherein the injection passage has an injection port that opens into the two-staged cylinder bore at a location adjacent an exhaust inlet portion of the exhaust passage and the injection port has an upper edge aligned substantially with an upper edge of the exhaust inlet port; and a rotary valve that simultaneously controls the air-fuel mixture to the air-fuel mixture passage and the air to the air passage.

12. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an injection passage for injecting the air within the auxiliary chamber into the combustion chamber, wherein the injection passage has an injection port that opens into the two-staged cylinder bore at a location adjacent an exhaust inlet port of an exhaust passage; and a relief valve for relieving a pressure inside the injection passage that is higher than a predetermined value, and a discharge passage through which the air from the relief valve is discharged, said discharge passage having a downstream end opening into the exhaust passage.

13. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber; and an injection passage for injecting the air within the auxiliary chamber into the combustion chamber, wherein the injection passage has a injection port that opens into an exhaust passage and is oriented towards the combustion chamber.

14. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an injection passage for injecting the air within the auxiliary chamber into the combustion chamber;

a first check valve for selectively opening or closing the air passage;

a second check valve for selectively opening or closing the air-fuel mixture passage;

a third check valve for selectively opening or closing the injection passage; and a fourth check valve comprised of a relief valve for relieving a pressure inside the injection passage that is higher than a predetermined value, the pressure at which the relief valve opens being set to a value higher than the pressure at which the third check valve opens.

15. The two-cycle combustion engine as claimed in claim 14, wherein the capacity of a portion of the injection passage which extends from the auxiliary chamber to the third check valve is set to a value smaller than the capacity of the auxiliary chamber then attaining when the two-staged piston is held at a bottom dead center.

16. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an injection passage for injecting the air within the auxiliary chamber into the combustion chamber, wherein the injection passage has an injection port opening in the two-staged cylinder bore; and a relief valve for relieving a pressure inside the injection passage that is higher than a predetermined value, the pressure at which the relief valve opens being set to a value substantially equal to or higher than a pressure within the combustion chamber that is attained when a scavenge outlet port of the scavenge passage opens as a result of a descending motion of the two-staged piston.

17. The two-cycle combustion engine as claimed in claim 16, further comprising a pressure accumulating chamber defined in the cylinder block at a location radially outwardly of the auxiliary chamber, said pressure accumulating chamber being communicated with the auxiliary chamber through a connecting path which extends in a direction perpendicular to a longitudinal axis of the two-staged cylinder bore to form a part of the injection passage, and a third check valve accommodated within the pressure accumulating chamber for selectively opening or closing the connecting path.

18. The two-cycle combustion engine as claimed in claim 17, wherein the injection passage has a plurality of injection ports defined on left and right sides of an exhaust inlet port, respectively, said pressure accumulating chamber and said injection ports being communicated with each other through a connecting passage forming a part of the injection passage.

19. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an exhaust passage for removing combustion gases from the combustion chamber; and an injection passage for injecting the air within the auxiliary chamber into the combustion chamber including a first and second injection ports for directing the air within the combustion chamber counter to an exhaust flow of the exhaust passage, and the first and second injection ports are positioned on respective opposite sides of an exhaust port on the cylinder bore for removing the combustion gases from the combustion chamber.

20. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber including a space between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an exhaust port in the cylinder bore for removing the combustion gases from the combustion chamber;

an injection passage for injecting the air within the auxiliary chamber into the combustion chamber including a first injection port on the cylinder bore for directing the air into the cylinder bore in a direction which retards the release of fluid flow through the exhaust port, and a second injection port for directing the air into the cylinder bore in a direction which retards the release of the fluid flow through the exhaust port, wherein the first and second injection ports are positioned on respective opposite sides of the exhaust port.

21. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber;

an injection passage formed in the cylinder block for injecting the air within the auxiliary chamber into the combustion chamber, wherein the injection passage has an injection port that opens into the two-staged cylinder bore at a location adjacent an exhaust inlet port of an exhaust passage; and a relief valve for relieving a pressure inside the injection passage that is higher than a predetermined value, and a discharge passage through which the air from the relief valve is discharged, said discharge passage having a downstream end opening into the exhaust passage.

22. A two-cycle combustion engine which comprises:

a cylinder block having a two-staged cylinder bore defined therein, said two-staged cylinder bore having a reduced diameter bore portion and a large diameter bore portion;

a two-staged piston having a reduced diameter piston portion and a large diameter piston portion and drivingly accommodated within the two-staged cylinder bore;

an annular auxiliary chamber defined between the large diameter bore portion of the two-staged cylinder bore and the reduced diameter piston portion of the two-staged piston;

an air-fuel mixture passage for introducing an air-fuel mixture into a crank chamber;

an air passage for introducing air into the auxiliary chamber;

a scavenge passage for supplying the air-fuel mixture within the crank chamber into a combustion chamber; and an injection passage formed in the cylinder block for injecting the air within the auxiliary chamber into the combustion chamber, wherein the injection passage has an injection port that opens into an exhaust passage and is oriented towards the combustion chamber.

* * * * *